United States Patent [19]

Roessler

[11] Patent Number: 5,024,272

[45] Date of Patent: Jun. 18, 1991

[54] DRILL PIPE DOWNHOLE UNTHREADING APPARATUS

[75] Inventor: Dennis E. Roessler, Houston, Tex.

[73] Assignee: Halliburton Logging Services, Inc., Houston, Tex.

[21] Appl. No.: 520,324

[22] Filed: May 7, 1990

[51] Int. Cl.[5] ..... E21B 31/20

[52] U.S. Cl. ..... 166/117.7; 166/240

[58] Field of Search ..... 166/301, 377, 240, 117.7; 285/39; 29/426.5

[56] References Cited

U.S. PATENT DOCUMENTS 3,322,006 5/1967 Brown ..... 166/117.7 X 3,434,543 3/1969 Webb ..... 166/377 X

FOREIGN PATENT DOCUMENTS 1102896 7/1989 U.S.S.R. ..... 166/377

*Primary Examiner*—William P. Neuder

*Attorney, Agent, or Firm*—William J. Beard

[57] ABSTRACT

An unthreading apparatus is set forth which includes upper and lower mandrels which thread together at a threaded connection which is made of threads having the same pitch as the pipe making up the drill string. There is an internal stem or shaft passing through the upper and lower mandrels. The shaft is provided with upper and lower cylinders, thereby enabling fluid under pressure to be introduced into the cylinders to drive the shaft to and fro. Through a ratchet type mechanism, shaft movement is converted into an unthreading motion for the two mandrels and they unthread, coupling unthreading action to the pin and box at a threaded joint in the drill string above the sticking point of the drill string. This enables the present apparatus to unthread at a particular location because it is locked at that location to straddle a particular threaded joint.

13 Claims, 2 Drawing Sheets

DRILL PIPE DOWNHOLE UNTHREADING APPARATUS

BACKGROUND OF THE DISCLOSURE

The present disclosure is directed to a drill pipe unthreading apparatus and particularly one which finds use in unthreading drill pipe which has become stuck. Assume, for purposes of illustration, that a drill string is in a well borehole and has drilled to 10,000 feet. Assume further, for purposes of description, that the drill pipe is stuck at a depth of 9,000 feet along the drill string. Sticking can arise as a result of many difficulties such as collapse of the hole, perhaps drift in the direction of the well which leads to key seating, or other conditions. When it becomes stuck, one procedure in retrieval is to rotate in the counterclockwise direction with the hope that the drill string will unthread above the stuck location. Sometimes, a bumper sub is threaded to the retrieved portion of the drill string with a hope that it can be threaded to the remaining string of pipe in the well to enhance jarring action. Obviously, the bumper sub should be as close as possible to the stuck point. If the drill string is stuck at 9,000 feet, and each drill pipe is precisely thirty feet in length, this means that 300 joints of pipe are above the stuck point. The pipe is hopefully unthreaded at the joint above by operating the rotary drilling rig in the opposite direction. Regrettably, unthreading can occur at any of the 299 threaded connections joining the 300 joints of pipe. It is highly desirable that unthreading occur at only one location. One approach heretofore has been to position a smaller pipe inside the drill pipe equipped with a ratchet mechanism having teeth which grip the inside of the drill pipe. This smaller pipe is rotated in the wrong direction to unthread the drill pipe. However, the smaller pipe yields somewhat due to elasticity of the metal of the small pipe string. It is therefore difficult to control the location of unthreading. The present disclosure is directed to a tool which can be lowered to any particular depth in the stuck pipe to thereby unthread the two pipe joints making a threaded connection in the drill string.

The two pipes are thus unthreaded with the assistance of the present apparatus. It operates so that unthreading torque is applied just at the single threaded connection. Relatively speaking, because either the pin or the box can be viewed as fixed, the other is rotated in the opposite direction to assure unthreading. This present apparatus spans that threaded connection and is therefore able to limit unthreading to that particular location. This can be accomplished without applying any torque whatsoever to the other portions of the drill string so that the remaining 298 threaded connections are not unthreaded. The unthreading apparatus of the present disclosure thus accomplishes unthreading at a particular location.

One of the helpful and preliminary steps is to determine the location at which the pipe is stuck. A free point indicator can be used to determine the point at which the drill string is stuck. Typically, sticking occurs in a region or at a location that can be precisely located. The present apparatus is therefore a system which can be lowered inside the stuck drill string and lowered to the region of sticking. It is lowered to that depth and then raised to the next joint thereabove. That is, it is finally located in the drill string where it straddles the pin and box threaded joint immediately above the stuck location so that unthreading can be accomplished at that joint. The present apparatus is ideally lowered on a relatively small gauge tubing string sometimes known as a spaghetti string and it is connected with the present apparatus to deliver fluid under pressure. By means of an appropriate valving apparatus fluid is applied first to one end and then to the opposite end of the tool to initiate reciprocation of an elongate shaft therein. This shaft is cooperative with upper and lower mandrels. These mandrels are threaded together at a threaded connection which has the same pitch as the pin and box connection making up the drill string. However, the upper and lower mandrels thread together with a larger number of threads so that the ultimate step of unthreading is accomplished between the pin and box in the drill string matched by unthreading in the present apparatus which, however, does not come apart because the number of threads in the threaded connection between the upper and lower mandrels is greater.

A valve is included which provides fluid for reversing the position of the shaft. As the shaft reciprocates to and fro, unthreading between the upper and lower mandrels occurs in ratcheting motion with a specified angular rotation for each stroke of the shaft. The upper and lower mandrels are gripped by wedging members, sometimes known as dogs, which hold against the drill string above and below the threaded joint so that unthreading is accomplished. After unthreading is finished, an upward pull on the drill string retrieves the unthreaded portion above the unthreaded joint and leaves the stuck lower portion. The tool of the present disclosure is released, unlocked, and retrieved from the borehole.

The present apparatus straddles a particular threaded joint to assure that unthreading occurs at that location. Unthreading is accomplished without applying any torque to the drill string from the surface. Unthreading is accomplished at the selected joint by means which applies the unthreading torque immediately adjacent to the joint, reversing the connection for unthreading to assure safety. This avoids the risk of partially unthreading many joints along the unstuck portion of the drill string.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
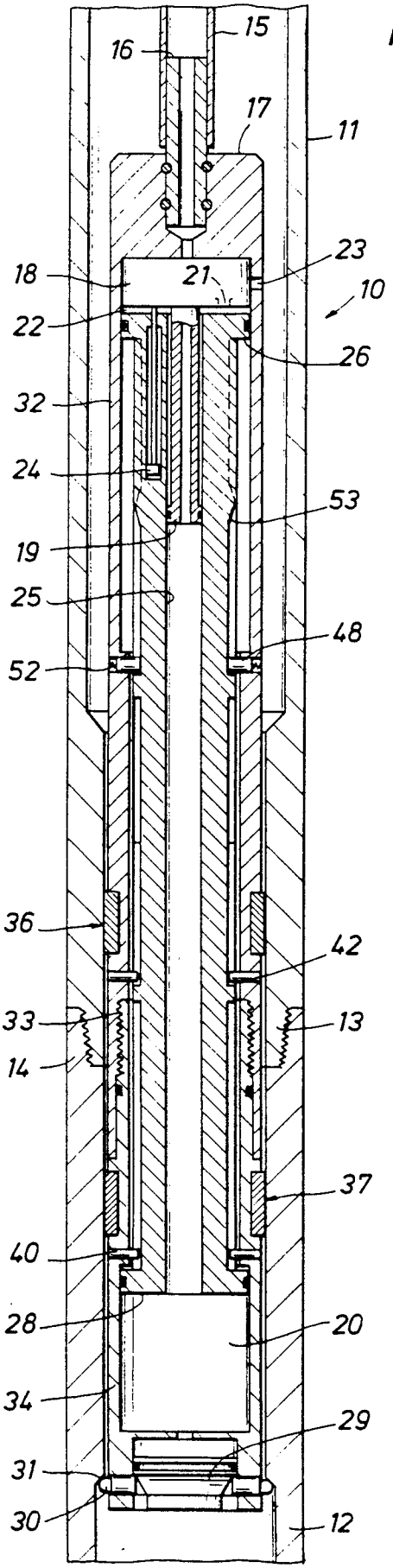
FIG. 1 is a sectional view through the unthreading apparatus of the present disclosure particularly illustrating installation in a drill string to span a threaded connection and further showing an internal shaft in the up position, and additionally showing certain pins cooperative with the internal shaft and upper and lower mandrels in the apparatus.

Attention is directed to FIG. 1 of the drawings where the numeral 10 identifies the unthreading apparatus of the present disclosure. The context of this device should be explained to enhance an understanding of its operation. Accordingly, it is located in a drill string formed of an upper joint of pipe 11 threaded to a lower joint of pipe 12 which make up the drill string. The upper joint terminates in a pin 13 which threads to a box end 14. A threaded connection is made up by a known type of threads such as various API standard threads or, alternately, with premium threads. As will be detailed hereafter, it is important to know the pitch of the threads to assure proper unthreading. The two tubular members that form the drill string have enlargements at the extremities which are thicker walls so that a tool joint is thereby defined. In the illustrated embodiment, there is an internal upset of sufficient radial dimension to assure that the location of the threaded connection is found. The internal upset at the threaded connection is spanned by the unthreading apparatus 10 which functions in a manner to be set forth.

The unthreading device 10 is lowered in the drill string until it is approximately even with or just below the threaded connection shown in FIG. 1. It can be lowered on a wireline or on spaghetti tubing. In the latter event, the tubing is used to provide a fluid flow path which is either connected from the beginning or after installation in the drill string. In any event, the sticking point is somewhere below on the drill string so that the joint 12 is held against rotation; the joint 11 will ultimately be freed from the lower portion of the drill string. The present apparatus accomplishes unthreading at this location. To this end, the unthreading apparatus 10 is lowered until it is just below the illustrated position in FIG. 1 and is subsequently raised. The spaghetti string 15 is used to deliver fluid pressure. The fluid flows into the equipment through the connected nipple 16 at the upper end of the tool. That connects to the head 17 and into a control valve 18. The control valve is provided with two outlets. One outlet is through a sealed line 19. The outlet line 19 fills a chamber 20 at the lower end of the tool. In similar fashion, there is an additional outlet 21 which fills a similar chamber 22 located at the upper end of the tool. A vent or outlet 23 from the valve 18 is also provided so that fluid is removed from the apparatus 10. This is required when the chambers 20 and 22 are selectively reduced in volume, forcing fluid previously admitted out of the tool. This valve 18 is therefore a four port valve which has two operative positions. In one position fluid is admitted through the spaghetti line 15 and out through the port 19 to fill the chamber 20 while simultaneously opening the port 21 to exhaust through the port 23. In the other state of the valve, the port 23 again is used to void fluid from the tool, but in this instance, it is voided from the chamber 20 back through the port 19 and out through the port 23. This occurs while the spaghetti line 15 is used to fill the chamber 22. The operative state of the valve 18 is determined by a control switch 24 which includes the extending rod which engages reciprocating parts in the tool as will be detailed.

Continuing with FIG. 1, the numeral 25 identifies an elongate hollow shaft. This shaft extends between identical pistons at the the two ends of the shaft. The upper piston 26 travels toward the valve 18, thereby reducing the chamber 22 in size. FIG. 1 shows this chamber to be reduced while the lower chamber 20 is enlarged. In similar fashion, there is a piston 28 at the lower end which defines the chamber 20. After downward movement, the chamber 20 is reduced. The chambers 20 and 22 are similar in operation and are chambers positioned to receive fluid under control of the valve 18 so that the shaft 25 is reciprocated. Both pistons are equipped with seal rings to prevent the escape of fluid from the chambers 20 and 22.

The lower end of the tool includes an upset lock mechanism formed by a movable piston 29 which controllably forces outwardly certain rounded lock pins 30. The preferred embodiment utilizes at least three and preferably about six lock pins 30 which are forced radially outwardly. The have rounded exposed surfaces. They are rounded so that they will slide over any shoulder at the upset. When extended and held outwardly, they bear against the adjacent shoulder 31 defining the enlargement or upset within the drill pipe 12. They are forced outwardly by movement of the piston 29 in the chamber for that piston. The piston 29 is equipped with a tapered external face to assure that it wedges against the pins 30 to drive them outwardly. When desired, the pins are locked in the extended position where they have a protruding spherical end adjacent to the upset shoulder. The piston 29, on reduced pressure, can move upwardly to permit the pins 30 to retract radially inwardly. By contrast, the piston 29, when exposed to increased fluid pressure, is forced downwardly to force the pins outwardly so that the upset shoulder 31 is positively engaged. When this occurs, the device 10 cannot be raised any farther. In operation, this can be achieved rather quickly. That is, the unthreading tool 10 is lowered to a depth, pressure in the spaghetti string is increased, and the tool is then raised. As it is raised, the pins 30 lock against the next upset encountered. This will hold the device at a particular depth to that it spans a particular threaded joint. Threaded connections are normally located every thirty feet in the drill string. The apparatus of this disclosure need not be more than about eight or ten feet in length. In fact, it can be scaled to a smaller dimension. In that light, it must be landed so that it is adjacent to and straddles a particular threaded joint as illustrated in FIG. 1 of the drawings.

Tracing through the construction of the present apparatus from the top, the head 17 is constructed to receive the valve 18 in a recessed area and the chamber 22 is therebelow. It has an elongate skirt 32 which extends therebelow and which will be described as the upper mandrel. The skirt 32 is concentric around the hollow shaft 25. Space is defined between the two, but fluid under pressure is not introduced into the space. The skirt 32 extends downwardly to a threaded connection 33. The skirt 32 is concentric to a lower skirt 34. It will also be denoted hereinafter as the lower mandrel. The skirts 32 and 34 are aligned, and are concentric about the shaft 25. Further, they thread together at a threaded connection 33 constructed with threads having the same pitch as the threaded joint in the drill string. The threaded connection, however, is made with a greater number of turns. It has approximately ten to twenty more turns. Moreover, the drill string may be constructed with a set of tapered threads; the threads 33 are not tapered. The threads 33 are similar to the pin and box connection in the drill string. When unthreading occurs, as will be shown in the contrast of FIG. 3, it occurs at both sets of threads, namely the threaded connection in the drill string as well as the threaded connection 33. But unthreading of the tool 10 is prevented by including more turns.

Figure 5:
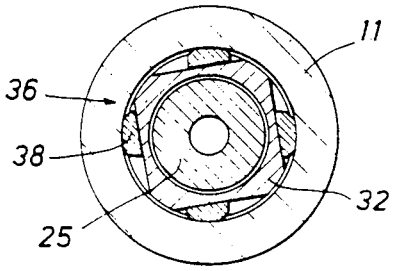
FIG. 5 is a sectional view along the line 5—5 of FIG. 3 showing a set of locking locking dogs which secure the upper mandrel to the drill string above the threaded joints.
Figure 6:
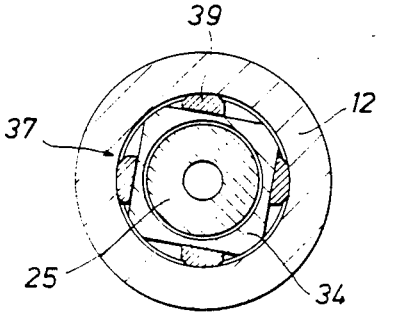
FIG. 6 is similar to FIG. 5 and shows a sectional view along the line 6—6 of FIG. 3 illustrating a similar mechanism for engaging the drill string below the threaded joint and which grips the drill string in the opposite hand to the structure shown in FIG. 5.

The upper mandrel supports a lock mechanism 36 while the lower mandrel supports a similar lock mechanism 37. FIG. 5 shows the upper lock mechanism 36, and the similar but opposite hand lock mechanism 37 is shown in FIG. 6. In both instances, the numeral 25 again identifies the central shaft. FIG. 5 shows the upper mandrel 32 while the lower mandrel 34 is shown in FIG. 6. The two mandrels operate locking dogs 38 and 39 respectively. The locking dogs have arcuate outer faces which curve to match the abutting face of the surrounding drill pipe. These faces are preferably either serrated or provided with roughened surfaces so that they will tend to drag. They are rotated in such a way to accomplish wedging action so that rotation is limited. In FIG. 5 of the drawings, relative counterclockwise rotation of the tool causes the dogs 38 to wedge while rotation in the opposite direction in FIG. 6 accomplishes the same. Once wedging occurs, further rotation is prevented by the wedges. They are so located and positioned that they operate together to grip the adjacent pipe so that it can be rotated on rotation of the attached mandrel. In other words, the upper mandrel locks with the upper joint of pipe to accomplish unthreading; the lower mandrel locks to and unthreads with the lower joint of pipe. Rotation between the two joints of pipe is provided by other elements of the tool 10 which will be described.

The lower mandrel supports pins 40. These interconnect with the shaft 25 to move in slots or grooves 41 in the shaft. These are better shown in FIG. 2 of the drawings which shows the outside face of the shaft. The slots 41 are sufficient in length to accommodate reciprocating motion of the shaft, which motion is varied slightly during unthreading. The upper mandrel supports a set of pins at 42 which interact with certain shoulders or grooves formed in the outer face of the shaft 25. A shallow V shaped recess is formed in the external face of the shaft to define the shoulders 43 and 44 which captures the pin 42 at that extremity of the V. This V is opposite a similar V defined by facing shoulders 45 and 46. From the illustrated full line position in the bottom V, the pin 42 moves relatively from contact with the shoulder 43 to slide upwardly in FIG. 2 adjacent the shoulder 44. Further travel carries the pin 42 relatively against the shoulder 45 and upwardly to the dotted line position at the top end of the shoulder 45. On reversal of the shaft movement, as will be described, the pin then moves along the shoulder 46. Further travel downwardly will carry it to a different V shaped pair of shoulders which will be explained in detail hereinafter. Another pin is illustrated at 48. This pin 48 is spring loaded radially inwardly while the pins 40 and 42 are fixed to the outer mandrels. The pin 48, however, is able to telescope to extend radially inwardly into a vertical slot 49. The slot 49 is immediately adjacent to a similar and adjacent slot 50 which extends toward the upper end of the shaft. More will be noted regarding the slots 49 and 50 hereinafter.

Figure 2:
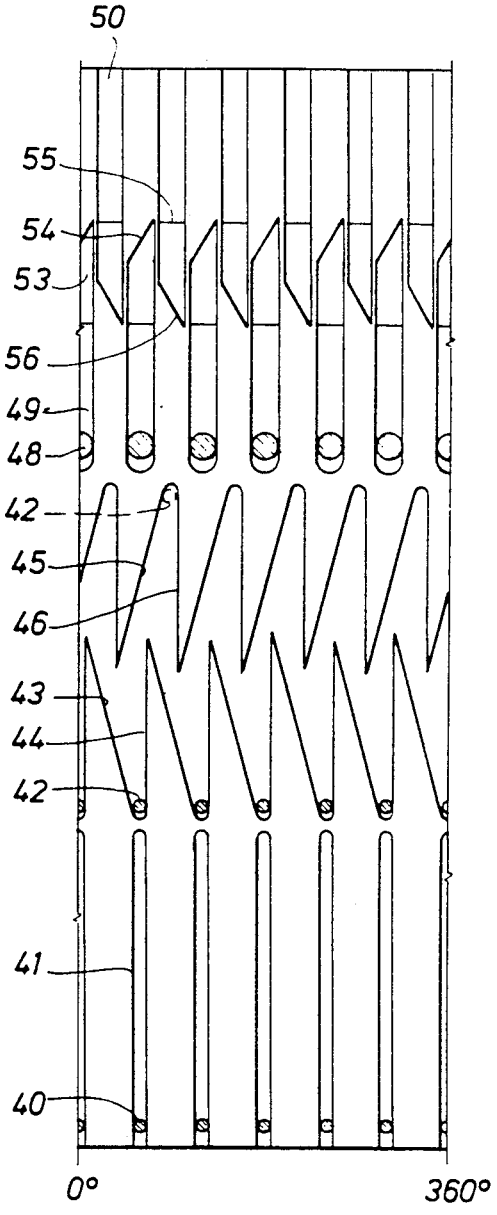
FIG. 2 is a view of the several pins and guide slots for these pins wherein the pins and slots fully encircle the interior of the equipment wherein FIG. 2 has been folded out into planar shape so that 360° of the surface area is illustrated.
Figure 3:
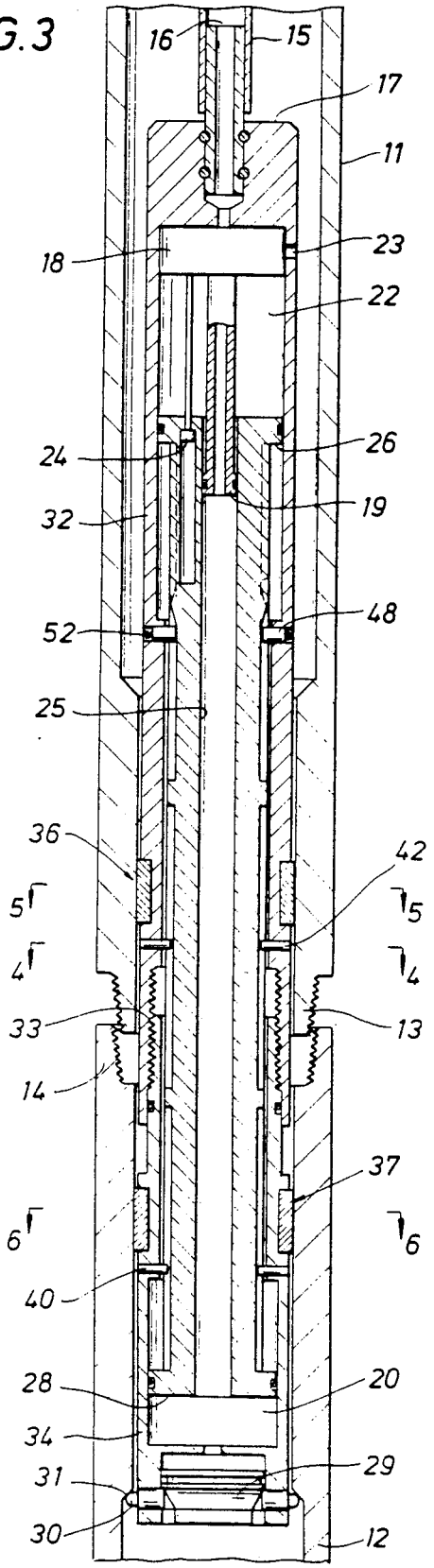
FIG. 3 is a view similar to FIG. 1 showing the tool joint substantially unthreaded as a result of operation of the present apparatus wherein the internal shaft is additionally contrasted by showing the shaft at the downward position in its travel.
Figure 4:
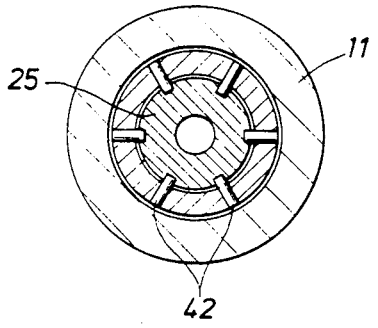
FIG. 4 is a view through the line 4—4 of FIG. 3 showing details of construction of a set of alignment pins for ratcheting operation.

Considering FIG. 2 as a whole, it operates so that a cycle of movement of the shaft 25 involves downward movement from the illustrated position of FIG. 1 to the position of FIG. 3 and return by upward movement. This cycle of movement causes relative rotation which unthreads the threads shown in FIG. 1. The lower mandrel 34 is permitted to reciprocate upwardly and downwardly but cannot relatively rotate. Rotation is prevented by the pin 40 engaging the slot 41. In other words, the slot 41 and pin 40 limit relative rotation of the lower mandrel 34 and, through the locking dog mechanism 37, this mandrel is locked to the lower drill pipe. The pin 42 is guided so that it travels through the facing V shoulders in FIG. 2. It travels from the full line position shown in FIG. 2 to the dotted line position, moves downwardly again and then upwardly. It additionally moves from the left of FIG. 2 to the right of FIG. 2 in steps. Recall that FIG. 2 is a panoramic view encircling the shaft. The pin 42 is able to move in upward and downward motion accompanied with relative rotation. This movement of the pin 42 causes unthreading. Here, it should be noted that the full circle view of the shaft has been unfolded in FIG. 2 in planar fashion. It is equipped with six sets of opposing V's so that six full strokes (one reciprocation involves extension and retraction) causes sixty degrees of movement. In other words, one full stroke of the shaft 25 is involved with sixty degrees of relative rotation between the upper and lower mandrels. The pin 48 likewise migrates in the same fashion as the pin 42. So to speak, one of the pins 48 moves from the lower left position upwardly, ratchets back downwardly and moves again upwardly so that it travels full circle through six repeated cycles of reciprocating motion. To this end, the preferred construction utilizes six pins 40, six pins 42 and six pins 48. Obviously, the device can be constructed with fewer or more pins so that the scale of operation can be varied. Briefly, each reciprocation is accompanied by sixty degrees of rotation assuming six pins so that the extent of rotation is $360° \div N$ where N equals the number of pins evenly spaced around the tool.

The pin and groove arrangement shown is FIG. 2 operates as a ratchet type mechanism which converts strokes of the shaft 25 into ratchet movements to unthread the equipment. For instance, assume that the shaft 25 reciprocates downwardly from the position shown in FIG. 1, traveling full length, and returning to the position of FIG. 1. When such a movement is made, the pin 40 makes a relative stroke up toward the top end of the groove 41. It then returns to the full line position shown at FIG. 2. This stroke holds the pin in a fixed location relative to the lower mandrel 34. In other words, the stem and lower mandrel are locked together by this particular motion. By contrast, the pin 42 travels a path which moves it from the wall 43 at the full line position shown in FIG. 2 along the shoulder 44, across the space to the shoulder 45 and to the dotted line position in the V between the shoulders 45 and 46. On the next stroke it then moves downwardly, and is guided so that it does not return to the beginning position but ratchets to the right as viewed in FIG. 2 through a movement of sixty degrees rotation. This engenders one sixth of a revolution unthreading at the threads 33. This derives from the fact that the pin 42 is joined to the upper mandrel while the pin 40 is connected to the lower mandrel. Accordingly, the pins 40 and 42 provide the unthreading motion which is accomplished at the threads 33.

As described to this juncture, ratcheting motion of the two mandrels with respect to each other can be accomplished by operation of the pins 40 and 42 which are shown in the lower portions of FIG. 2. The pin 48, however, provides a separate function which prevents backing up, so to speak, resulting from a resiliency of the materials used to make the equipment. Assume that the threads 33 offer some resistance to unthreading. This resistance must be added to the resistance against unthreading at the threads in the drill string. This is a substantial resistance to unthreading. When the present apparatus is operated, the reciprocating shaft 25 is driven along the length of the tool. Torque is created between the pins 40 and 42 which is resisted by the stiffness of the shaft. While the shaft may be perfectly constructed, it is nevertheless made of steel products which are somewhat resilient and which may twist in response to the loading applied to it. This may cause the pin 42 to track incorrectly as it travels from the down position to the up or dotted line position in FIG. 2. It may return in the wrong direction as a result of untwisting of the shaft 25. The pins 48 cooperate with the grooves 49 and 50 to force ratcheting movement which prevents backing up. This resistance to backing up involves the following movements of the pins 48.

Briefly, the pin 48 is held in position by means of a small spring 52 which is axially pressed against the short pin 48. The pin 48 thus is held in position by a surrounding sleeve around the several pins 48 and which is located so that the pins force radially inwardly. The pin 48 moves in the recessed groove 49 until it encounters a ramp portion 53. At the ramp portion 53, the pin is forced radially outwardly as the pin rides up the ramp. The pin will ultimately come close to the top end shoulder 54. That shoulder provides a terminus for the ramp portion 53, and forces the pin up and out to the right. When it moves to the right, it moves into alignment with the other set of grooves at 50. The grooves or slots 50 are constructed in a similar fashion. That is, they are formed to full depth along the major portion of their length, and have ramp portions which begin at 55. The ramps 55 extend closer to the surface, terminating at a shoulder 56, the shoulder tending to force the pin to the side. Thus, the pins ride up the ramps, encounter the angularly positioned shoulder and move to the right as viewed in FIG. 2. The pathway for the pin 48 at the left extremity of FIG. 2 is therefore upwardly in the groove or slot 49, along the ramp 53 as the pin is forced out of the ramp, against the shoulder 54, and then into the adjacent slot. In the adjacent slot, return to the slot to the left is prevented. In this fashion, the pin 48 is guided so that it cannot retrace its original course of movement.

The pin movement sequence just described assures ratcheting movement in the correct direction. This overcomes the tendency of the equipment of the present apparatus to elastically twist under load. Moreover, this assures that the pin 48 is guided so that duplicated movement occurs with each operation. Of course, the movement of a single pin is repeated for all the several pins 48.

OPERATION OF THE PRESENT APPARATUS

Assume, for purposes of discussion, that a drill string is stuck where the point of sticking is 9,000 feet deep, and the pipe schedule indicates that there are 299 threaded connections between the surface and the sticking point. The unthreading tool 10 is connected with the spaghetti tubing 15 and is lowered into the drill string. The fluid pressure on the spaghetti string is maintained at a low pressure. The pressure is low, perhaps just a few psi sufficient in the system. If the pressure is quite low, and yet sufficient to charge the system, the piston 29 can be pumped down somewhat as shown in FIG. 1, and the rounded pins 30 will then extend. It is not necessary that they extend fully. The extended pins then are sufficiently wide that the internal upsets at the threaded joints will force the pins 30 inwardly assuming sufficient recoil in the hydraulic system. This causes a pressure peak which can be used as a technique for counting tool joints. Alternately, the spaghetti tubing length can simply be measured as the unthreading device is lowered. In any event, it is lowered to the location where the internal upset corresponds to the desired depth in the pipe string. Since this typically is a target depth, and the tool is stopped at that depth. It may land between upsets, or in the middle of a joint of pipe with a threaded connection above the tool.

The pressure in the tool 10 is then increased by providing additional pressure through the spaghetti tubing. The tool is then raised until it can move no farther which indicates that the rounded pins 30 have caught under the upset to assure that the tool spans the threaded joint. At this juncture, the valve 18 is initially set so that the application of fluid pressure to the valve 18 assures that the shaft 25 moves to the up position, or the position illustrated in FIG. 1 of the drawings. The pressure is brought to the full operating pressure necessary for operation of the tool. When this occurs, fluid pressure fills the topmost chamber 22 and drives the shaft 25 downwardly as shown in FIG. 3 of the drawings. This downward travel and the following upstroke provides relative rotation between the upper and lower mandrels. They are relatively rotated so that the gripping members shown in FIGS. 5 and 6 move into the gripping relationship shown in those views. In other words, the upper mandrel grips the upper pipe and the lower mandrel grips the lower pipe. The grips are held by wedging action. If slippage occurs, the stroke is repeated two or three times to assure that the grip is ultimately made. In any event, the shaft 25 is reciprocated. This reciprocation occurs under control of the valve 18 which is operated by the rod 24 so that repeated reciprocation is accomplished. The rate of pumping fluid into the spaghetti line controls the rate of shaft travel. For instance, while the chamber 22 fills with fluid, the shaft continues downward motion until a signal is provided to the valve 18 by means of the control rod 24. When this occurs, the valve 18 reverses. At that point, the chamber 22 is connected through the port 23 to empty the chamber 22 while the chamber 20 is then filled. This filling forces the shaft upwardly to the position shown in FIG. 1. Each downstroke followed by an upstroke represents one cycle of operation. Each cycle of operation is accompanied by sixty degrees of rotation relatively accomplished between the upper and lower mandrels. These two mandrels rotate in an angular amount determined by the width of the pin and groove system shown in FIG. 2. Since there are six positions around the full circle, each shift in position represents sixty degrees. If there were ten pins and ten identical grooves with equal spacing, then the angular advancement would be thirty-six degrees. Eight steps would correspond to forty-five degrees. As can be seen, six full steps are required to make one full revolution between the upper and lower mandrels which unthread by this amount. The threads 33 include a greater number of threads in the connection so that unthreading is accomplished between the two mandrels but the unthreading tool 10 does not come apart. The threads 33 have the same pitch as do the threads in the drill string. If, for instance, the drill string pin and box require ten revolutions to unthread sufficiently for disconnection, then the present apparatus requires sixty strokes to accomplish the ten revolutions. Generally, this can be observed at the surface by small fluctuations in fluid flow rate or pressure or both by monitoring the pumping equipment connected to the spaghetti tubing. When these occur, the reversals can be counted so that the full ten revolutions are then accomplished. At that juncture, unthreading should be complete. This permits reduction of pressure in the spaghetti tubing. This can be tested by pulling on the drill string. This should enable the top portion of the drill string to be removed.

Progress during unthreading can also be observed at the surface where the upper end of the drill string is rotated. It should be freed of connections which might otherwise prevent rotation at the surface. It may be necessary to install a swivel in the spaghetti tubing to permit relative rotation of the unthreading apparatus 10 which would otherwise twist the spaghetti tubing. Once unthreading has been completed, the present apparatus can then be retrieved by reduction of the hydraulic pressure followed by jarring on the equipment. This normally will dislocate the unidirectional latching mechanisms shown in FIGS. 5 and 6 so that disconnection is then possible. It is not necessary ordinarily to back up by any substantial measure to achieve this disconnection.

In conclusion, the foregoing describes the operation of the unthreading apparatus. It is a device which typically has a length approaching about ten feet, or perhaps less depending on scale values. It is preferably provided with a suitable connection to the fluid tubing connected therewith, typically with a swivel connection. Alternately, a fishing neck can be installed on the unthreader 10. Another mode of operation is to lower the unthreader 10 on a wireline; once it is located at the right depth, it can be connected by a hose or tube for fluid under pressure. Should the wrong joint be unthreaded, the present invention can be inverted and used in an upside down manner to rethread a single threaded connection. The unthreading apparatus is able to be moved quickly to field installations where a stuck drill string is located so that emergency relief can be obtained to thereby reduce the down time in the drilling operation.

While the foregoing is directed to the preferred embodiment, the scope thereof is determined by the claims which follow.

What is claimed is:

1. Apparatus for unthreading a threaded connection in a drill string, the apparatus comprising:

(a) an elongate shaft;

(b) fluid powered means for moving said shaft in repeated movement between first and second positions:

(c) upper and lower mandrels supporting said shaft and exposed to joints making up the drill string, said mandrels joining together to permit rotation therebetween;

(d) upper and lower pipe gripping means cooperatively engaging pipe joints in the drill string wherein said upper pipe gripping means engages a pipe joint above a threaded connection in the pipe string and said lower pipe gripping means engages a pipe joint below the threaded connection in the pipe string; and (e) means coupling said shaft to impart repeated movement through said upper and lower mandrels and pipe gripping means to the pipe joints so that the threaded connection in the pipe string is rotated to unthread.

2. The apparatus of claim 1 wherein said shaft is moved by (a) spaced upper and lower cylinder;

(b) upper and lower pistons in said cylinders; and (c) valve means controllably introducing fluid under pressure to said cylinders in a sequence to move said shaft between upper and lower positions.

3. The apparatus of claim 1 including a tubing string for extension through a drill string, and valve means provided with fluid under pressure from said tubing string wherein said valve means is switched between two operative conditions, and said valve means provides fluid under pressure to move said shaft between said first and second positions.

4. The apparatus of claim 3 wherein said valve means connects to (a) spaced upper and lower cylinders having pistons therein;

(b) means connecting said pistons to said shaft to linearly move said shaft; and (c) ratchet means connected to said shaft to rotate relatively said upper and lower mandrels.

5. The apparatus of claim 4 wherein said upper and lower mandrels are threaded together by a set of threads which are (a) equal in pitch to the threads in the threaded connection in the pipe string;

(b) threaded in the same hand; and (c) sufficiently greater in number of threads that the upper and lower mandrel remain threaded together after the pipe string threaded connection is unthreaded.

6. The apparatus of claim 1 wherein said upper and lower pipe gripping means each includes a set of dogs abutting the pipe string and said dogs are arrangeed adjacent a supportive surface for forcing said dogs into contact with said pipe string to grip the pipe string above and below the threaded connection.

7. The apparatus of claim 6 wherein said pipe gripping means are spaced apart to enable gripping above and below the threaded connection, and the grip is unidirectional for unthreading.

8. The apparatus of claim 7 wherein said upper and lower mandrels form an external housing around said shaft, and said shaft telescopes within said mandrels in moving between the first and second positions.

9. The apparatus of claim 8 including a ratchet means connected between one of said mandrels and said shaft to permit telescoping shaft movement without relative rotation, and additionally connected to the other of said mandrels to permit telescoping shaft movement with relative rotation.

10. The apparatus of claim 9 wherein said ratchet means permits mandrel relative rotation to unthread the threaded pipe connection in the pipe string.

11. A downhole tool for positioning in a pipe string to unthread a selected threaded connection in the pipe string; the tool comprising:

(a) upper and lower mandrels exposed to joints making up the drill string, said mandrels joining together to permit rotation therebetween;

(b) upper and lower pipe gripping means cooperatively engaging pipe joints in the drill string wherein said upper pipe gripping means engages a pipe joint above a threaded connection in the pipe string and said lower pipe gripping means engages a pipe joint below the threaded connection in the pipe string;

(c) hydraulically powered reciprocating piston and ratchet means connected to said upper and lower mandrels so that one of said mandrels cannot rotate relative to said piston and ratchet means, and said piston and ratchet means rotates said other mandrel in a direction that provides unthreading rotation to the threaded connection in the pipe string; and (d) means aligning said upper and lower mandrels so that said upper and lower pipe gripping means contact and grip the pipe string above and below the threaded connection to unthread the threaded connection.

12. The apparatus of claim 11 wherein aligning means includes means abutting an internal shoulder of the pipe string to align said upper and lower pipe gripping means in the pipe string and spanning the threaded connection.

13. The apparatus of claim 12 wherein said aligning means is extended to operate by controllably applying fluid under pressure thereto from the surface.

* * * * *